United States Patent [19]

Herbstman et al.

[11] Patent Number: 5,039,307

[45] Date of Patent: Aug. 13, 1991

[54] DIESEL FUEL DETERGENT ADDITIVE

[75] Inventors: Sheldon Herbstman, Wappingers Falls; Kashmir S. Virk, Hopewell Jct.; Theodore E. Nalesnik; Nicholas Benfaremo, both of Wappingers Falls, all of N.Y.

[73] Assignee: Texaco Inc., White Plains, N.Y.

[21] Appl. No.: 590,742

[22] Filed: Oct. 1, 1990

[51] Int. Cl.[5] ..... C10L 1/22

[52] U.S. Cl. ..... 44/347; 44/348

[58] Field of Search ..... 44/347, 348

[56] References Cited

U.S. PATENT DOCUMENTS 4,501,595 2/1985 Sung et al. ..... 44/347
4,533,361 8/1985 Sung et al. ..... 44/347
4,699,724 10/1987 Nalesnik et al. ..... 252/51.5 A
4,919,684 4/1990 Nalesnik et al. ..... 44/347
4,919,685 4/1990 Herbstman et al. ..... 44/347

*Primary Examiner*—Jacqueline V. Howard
*Attorney, Agent, or Firm*—Robert A. Kulason; James J. O'Loughlin; Vincent A. Mallare

[57] ABSTRACT

A diesel fuel composition comprising:

(a) a major portion of a diesel fuel, and (b) a minor amount, as a diesel fuel injector detergent additive, of a Mannich coupled product of bis-polyisobutylene succinimide of an amine, prepared by:

(i) reacting an alkenyl succinimide acid anhydride with an amine to form a bis-succinimide;

(ii) treating the bis-succinimide with nonylphenol in the presence of an aldehyde to form a Mannich phenol coupled bis-succinimide product; and (iii) recovering the product Mannich phenol coupled bis-succinimide.

5 Claims, 2 Drawing Sheets

GM 6.2L ENGINE INJECTOR DEPOSIT TEST
INJECTOR AIR FLOW RESULTS

DIESEL FUEL DETERGENT ADDITIVE

BACKGROUND OF THE INVENTION

This invention relates to diesel fuels, and more particularly, to a diesel fuel detergent additive.

In the use of diesel fuels in diesel engines, the fuel's degradation products build up on metal surfaces and clog the injectors of the diesel engines.

When diesel fuel injectors become clogged or develop deposits, the spray of the fuel into the combustion chamber is not uniform and/or atomized properly, resulting in poor combustion, increased exhaust emissions and smoke and degraded fuel economy and power. Eventually, these deposits build up to the point which would require replacement or some special maintenance. In extreme cases, irregular combustion could cause hot spots on the piston which have resulted in total engine failure requiring a complete engine overhaul or replacement.

Since there has been a need for making certain that diesel fuel injectors are clean during operation of the diesel engines, additives have been developed to clean diesel fuel injectors.

According to the present invention, it has been found that a Mannich coupled bis-succinimide is an excellent cleaning agent for diesel fuels since it prevents diesel fuel injectors from clogging. This result was unexpected since it was not thought that the cleaning agent in the gasoline detergent would be sufficiently thermally stable to withstand the high temperatures found at the fuel injector tips of the diesel engine.

Thus, it is an object of the present invention to provide a means for keeping diesel fuel injectors clean and to provide an additive for such diesel fuels to aid in the removal of deposits in diesel engines.

DISCLOSURE STATEMENT

U.S. Pat. application No. 07/062,019 discloses a diesel fuel injector detergent which comprises a solvent, an alcohol, an amino alkylene-substituted asparagine and an N-alkyl-alkylene diamine.

U.S. Pat. application No. 07/269,340 discloses a diesel fuel and injector cleaning agent which comprises a solvent, and an N-alkyl-alkylene diamine.

U.S. Pat. application No. 07/269,343 discloses a diesel fuel and injector cleaning additive which comprises a solvent such as a ($C_3$–$C_5$) alcohol and an amino alkylene-substituted asparagine.

SUMMARY OF THE INVENTION

This invention provides a diesel fuel composition which comprises:

(a) a major portion of a diesel fuel, and (b) a minor amount, as a diesel fuel injector detergent additive, of a Mannich coupled product of bis-polyisobutylene succinimide of an amine, prepared by:

(i) reacting an alkenyl succinimide acid anhydride with an amine to form a bis-succinimide;

(ii) treating the bis-succinimide with nonylphenol in the presence of an aldehyde to form a Mannich phenol coupled bis-succinimide product; and (iii) recovering the product Mannich phenol coupled bis-succinimide.

DRAWINGS

The advantages of the present invention will be more clear from the description set forth below, particularly when considered with the drawings.

FIG. 1 is a graph illustrating the results of a single cylinder engine which compares a base diesel fuel with that of a diesel fuel containing a commercial additive and another diesel fuel containing the detergent additive of the present invention; and FIG. 2 is a schematic view of the injector air flow measurement test for determining the effectiveness of diesel fuel injector additives.

The commercial additive that is used in the present test comparison with the present detergent additive is manufactured and sold by Paramins Corporation of Houston, Texas, under the tradename of ECA-8477.

DETAILED DESCRIPTION OF THE INVENTION

Figure 1:
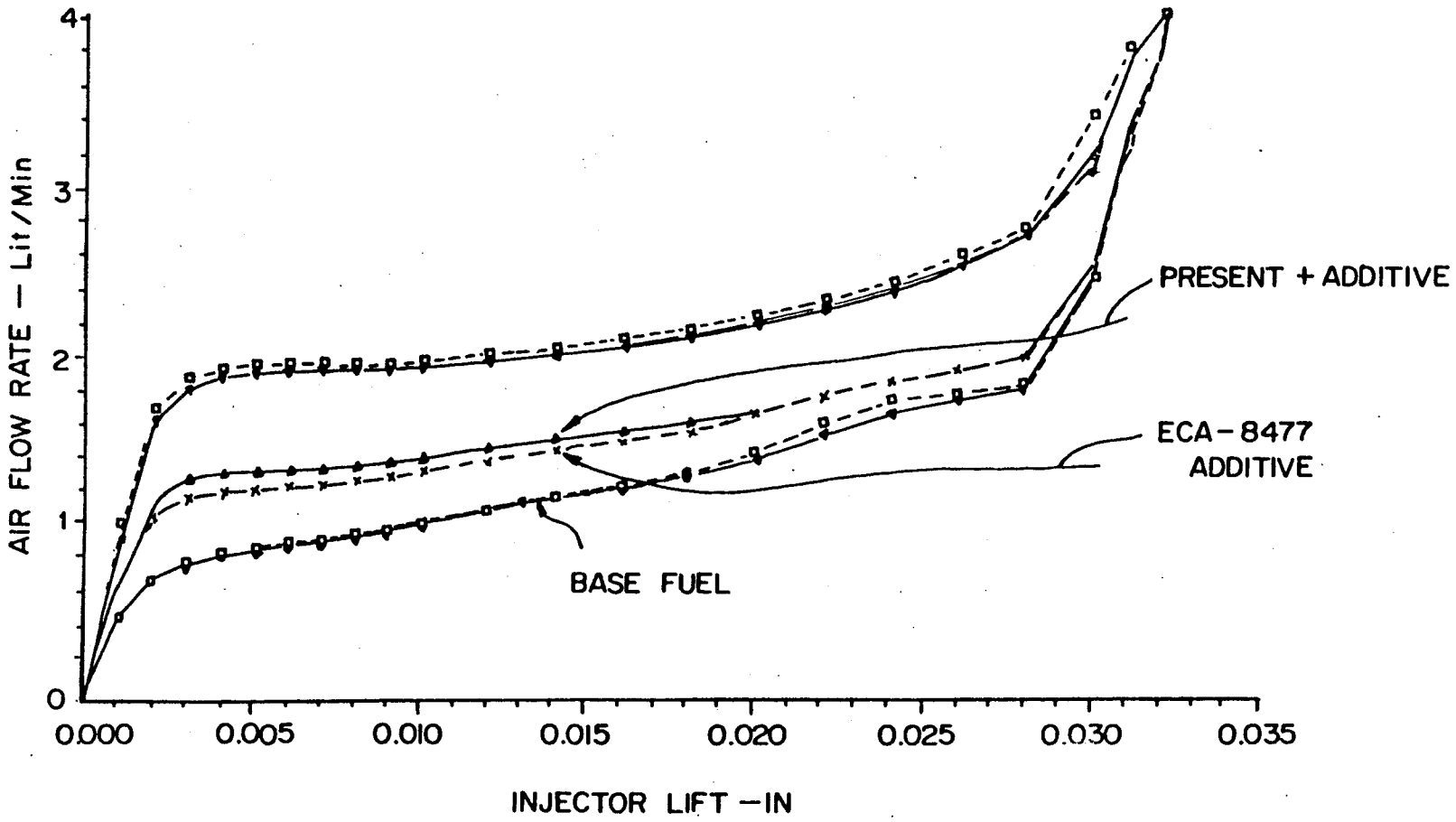

Generally, diesel engines usually run harder and not as well in cold weather as they do in warm weather. The reason being that the diesel fuel injectors become clogged due to the fuel thickening and not flowing easily.

The present invention utilizes a detergent additive in a diesel fuel composition to make certain that the fuel injectors are kept clean and functioning properly.

The diesel fuel composition comprises:

(a) a major portion of a diesel fuel, and (b) a minor amount, as a diesel fuel injector detergent additive, of a Mannich coupled product of bis-polyisobutylene succinimide of an amine, prepared by:

(i) reacting an alkenyl succinimide acid anhydride with an amine to form a bis-succinimide;

(ii) treating the bis-succinimide with nonylphenol in the presence of an aldehyde to form a Mannich phenol coupled bis-succinimide product; and (iii) recovering the product Mannich phenol coupled bis-succinimide.

In preparing the effective additive for removing deposits from diesel fuel injectors, an alkenyl succinimide acid anhydride (ASAA) is used which contains polyisobutylene (PIB) groups which have a molecular weight ranging from about 100 to about 3000. The preferred molecular weight being about 1500, and the most preferred being about 1300. This alkenyl succinimide acid anhydride is identified as H-50 ASAA, H-300 ASAA, H-1500 ASAA, and the like.

The alkenyl succinimide acid anhydride is reacted with an amine selected from the group consisting of pentaethylene hexamine (PEHA), diethylenetriamine (DETA), triethylenetetramine (TETA) and tetraethylenepentamine (TEPA).

The amine and ASAA (alkenyl succinimide acid anhydride) which has a polyisobutylene (PIB) radical attached, are reacted at a temperature of about 80° C. to about 120° C. for about 1 to 2 hours to produce a bis-succinimide. The bis-succinimide is then reacted with nonylphenol

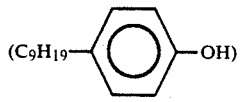

and paraformaldehyde $(CH_2O)_x$ to form the product additive i.e., a Mannich phenol coupled bis-succinimide.

The bis-succinimide is reacted with the nonylphenol and paraformaldehyde at a temperature of about 80° C. to about 120° C.

The process for preparing the present detergent additive "succinimide" useful in removing deposits from clogged injectors of diesel engines, is illustrated below in the Flow Diagram.

As shown in the Flow Diagram, the process includes essentially two steps which are:

(1) reacting an alkenyl succinimide acid anhydride (ASAA) with an amine such as pentaethylenehexamine (PEHA) to provide a bis-succinimide; and (2) then reacting the bis-succinimide with nonylphenol and paraformaldehyde to produce the additive product Mannich coupled bis-succinimide.

FLOW DIAGRAM

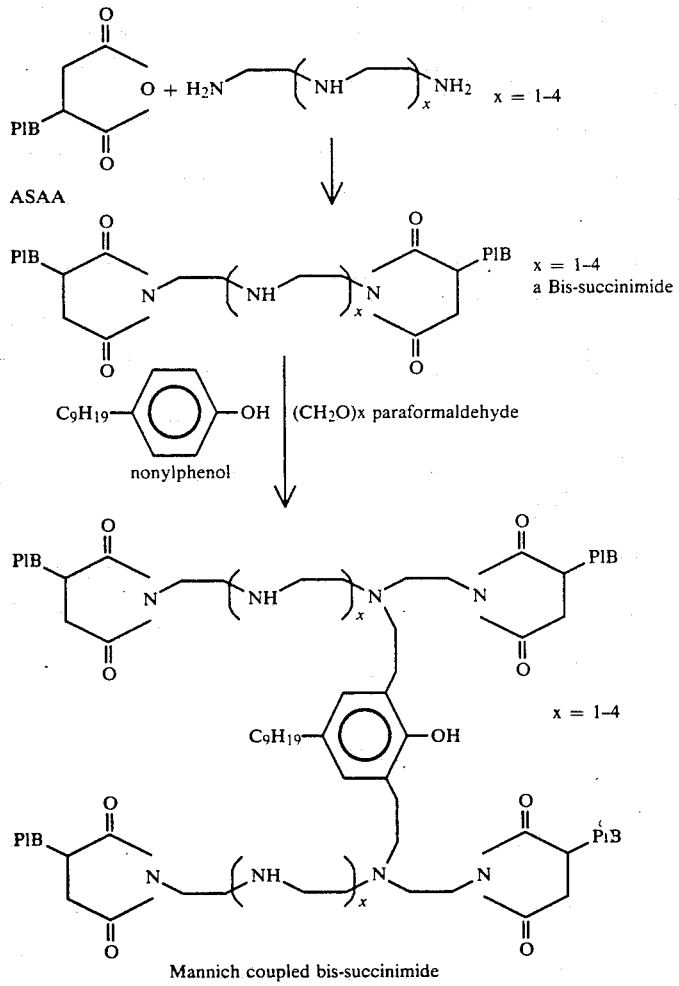

The advantages of the present invention will be more apparent when considering the following examples:

EXAMPLE 1

Preparation of Mannich Reaction Product Additive

Into a 4 neck 12 liter round bottom flask equipped with a mechanical stirrer, was added the 100 E Pale Stock HF (3200 g) and the alkenylsuccinic acid anhydride (4000 g, 1.15 moles). The mixture was stirred under nitrogen and then pentaethylene hexamine (167 g, 0.63 moles) was added and the reaction mixture heated to 120° C. and maintained for 2 hrs. Nonylphenol (70.9 g, 0.315 moles) was then added followed by the formalin (i.e., paraformaldehyde) solution (37%) (102 g, 1.26 moles) which was added over ten minutes. As a result of these additions, the product additive (i.e., Mannich phenol coupled bis-succinimide) was obtained.

EXAMPLE II

Comparison Tests of Cleaning Additives

Figure 2:
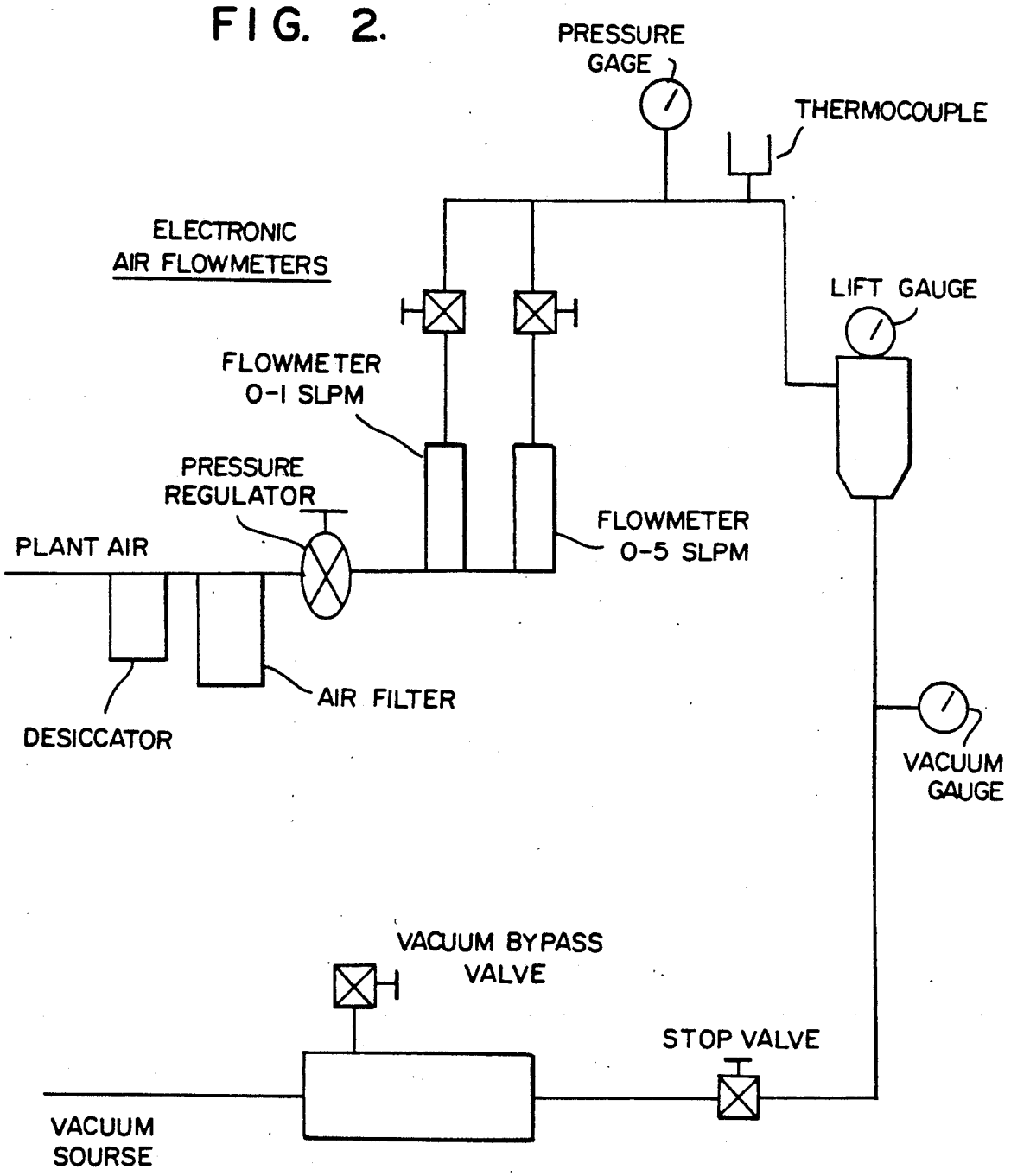

In order to show the injector cleaning effectiveness of the present additive, test were conducted using a 1987 GM 6.2 liter V-8 swirl chamber (Ricardo Comet V design), light duty engine. In the GM Engine Injector Test, outward opening pintle injectors were used. All tests were conducted without using exhaust gas recirculation. During injector deposit build up and clean up studies, the engine was operated under 1500 RPM and 180 ft-lb (71.7 BMEP) load conditions. Before starting a test, the injector's air flow rates were measured at needle lifts of 0.003 through 0.028 inches. A schematic of the injector air flow measurement setup is shown in FIG. 2.

In the tests, 60 PTB of each additive tested was used.

After a 15 hour test at 60 PTB, the present additive only plugged 27% of available flow capacity of the engine's eight (8) flow injectors. By contrast, 60 PTB of ECA-8477, the commercial detergent additive, plugged 31% of the injector capacity (as shown in FIG. 1).

The percentage of plugged injectors is determined by the formula below which uses the averaged value of the eight injectors.

$$\text{Percent Injector Plugged} = \frac{\text{Average Clean Injector Air Flow} - \text{Average Dirty Injector Air Flow}}{\text{Average Clean Injector Air Flow}} \times 100$$

Additional additives may be made using diethylenetriamine (DETA), triethylenetetramine (TETA) or tetraethylenpentamine (TEPA) instead of pentaethylenehexamine (PEHA) on an equimolar basis. Also various phenolic compounds may be used in place of nonylphenol.

We claim:

1. A diesel fuel composition comprising:

(a) a major portion of a diesel fuel, and (b) a minor amount, as a diesel fuel injector detergent additive, of a Mannich coupled product of bis-polyisobutylene succinimide of an amine, prepared by:

(i) reacting an alkenyl succinimide acid anhydride with an amine to form a bis-succinimide;

(ii) treating the bis-succinimide with nonylphenol in the presence of an aldehyde to form a Mannich phenol coupled bis-succinimide product; and (iii) recovering the product Mannich phenol coupled bis-succinimide.

2. The diesel fuel composition of claim 1, wherein said amine is selected from the group consisting of pentaethylene hexamine, diethylenetriamine, triethylenetetramine, and tetraethylene pentamine.

3. The diesel fuel composition of claim 1, wherein said alkenyl succinic acid anhydride has polyisobutenyl groups with a molecular weight ranging from about 100 to about 3000.

4. The diesel fuel composition of claim 2, wherein said amine is pentaethylenehexamine.

5. The diesel fuel composition of 3, wherein the molecular weight of the polyisobutenyl group of said succinic acid anhydride is about 1300.

* * * * *